US007930964B1

(12) United States Patent
Dillon

(10) Patent No.: US 7,930,964 B1
(45) **Date of Patent: *Apr. 26, 2011**

(54) MACHINE GUN

(76) Inventor: Michael J. Dillon, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/284,903

(22) Filed: Sep. 26, 2008

Related U.S. Application Data

(63) Continuation of application No. 11/585,529, filed on Oct. 24, 2006, now Pat. No. 7,441,490.

(51) Int. Cl.
*F41F 1/10* (2006.01)

(52) U.S. Cl. ..... 89/12; 89/13.05

(58) Field of Classification Search ..... 89/12, 13.05
See application file for complete search history.

(56) References Cited

U.S. PATENT DOCUMENTS

| | | | | |
|---|---|---|---|---|
| 3,143,922 | A * | 8/1964 | Altschuler et al. | 89/12 |
| 3,407,701 | A * | 10/1968 | Chiabrandy | 89/126 |
| 3,760,683 | A * | 9/1973 | Seemann | 89/12 |
| 4,046,056 | A * | 9/1977 | Carrie | 89/12 |
| 4,216,698 | A * | 8/1980 | Chiabrandy | 89/12 |
| 4,481,859 | A * | 11/1984 | Dix | 89/12 |
| 4,550,641 | A * | 11/1985 | Bruderer et al. | 89/12 |
| 5,413,025 | A * | 5/1995 | Martin | 89/8 |
| 5,817,967 | A * | 10/1998 | Simon | 89/12 |
| 6,443,044 | B1 * | 9/2002 | Dillon | 89/12 |
| 6,742,434 | B1 * | 6/2004 | Dillon | 89/12 |
| 7,441,490 | B2 * | 10/2008 | Dillon | 89/12 |

* cited by examiner

*Primary Examiner* — Bret Hayes
(74) *Attorney, Agent, or Firm* — Bennet K. Langlotz; Langlotz Patent & Trademark Works, Inc.

(57) ABSTRACT

A Gatling-type minigun eliminates the hazards to the operator of the minigun associated with hang fire and overpressure situations by providing a vented rotor assembly to redirect high-pressure gases and associated debris forward of the rotor assembly and away from the operator.

17 Claims, 5 Drawing Sheets

MACHINE GUN

REFERENCE TO RELATED APPLICATION

This is a Continuation application of U.S. patent application Ser. No. 11/585,529 of the same title, filed Oct. 24, 2006 now U.S. Pat. No. 7,441,490.

FIELD OF THE INVENTION

This invention relates generally to Gatling type machine guns and, more specifically, to the class of such guns known as 7.62 miniguns.

BACKGROUND AND SUMMARY OF THE INVENTION

This invention relates generally to Gatling type machine guns and, more specifically, to the class of such guns known as 7.62 miniguns and an improved rotor assembly for use therein that serves to vent high pressure gases and shrapnel that result from over-pressure situations and hang fires.

The 7.62 mm minigun is a six-barreled electric driven Gatling type machinegun originally designed and built by General Electric Company in the mid 1960's for the U.S. military. The minigun has been in use since its inception by both U.S. and foreign military forces.

The 7.62 minigun fires a conventional 7.62 NATO cartridge that includes a bullet, a cylindrical cartridge case, a primer, and powder. The bullet is seated in the open end of the cartridge case; the primer is seated in the center of the base of the cartridge case opposite the bullet; and the powder is located inside the cartridge case between the bullet and the primer. The cartridge is fired by first detonating the primer, which ignites the powder, and in turn, causes pressure within the cartridge case to increase to the point that the bullet is forced out of the cartridge case and down the barrel of the gun.

The 7.62 minigun includes a main housing enclosing and supporting a main rotary body known as the rotor assembly. Inside the main housing, cartridges are handled by bolt assemblies, of which there are six, one associated with each of the six barrels. Each of the six bolt assemblies is aligned with respective ones of the six barrels. The six bolt assemblies are attached to and positioned around the rotor assembly. The rotor comprises the core axis of the minigun. The six barrels are connected to the forward portion of the rotor and are arranged for rotation as a cluster around the core axis of the minigun. As the rotor rotates, the bolt assemblies are driven forward and rearward by a helical cam incorporated within the main housing. The helical cam operates to cause cartridges to be delivered to the bolt assemblies, chambered in a barrel, and then fired. The empty cartridges are extracted from the chambers and ejected. The rotor is rotated by means of a series of gears driven by an electric motor.

The majority of the high-pressure gases and shrapnel generated by a hang fire or overpressure situation are directed into the area between the rotor assembly and the main housing. The high-pressure gasses and shrapnel are then forced to e~cape at high velocity through various openings in the housing, thereby subjecting the operator to possible injury.

A hang fire refers to the firing, or detonation, of a cartridge that is out of battery. A cartridge is "out of battery" when it is not chambered and locked into the chamber of a barrel. Under normal circumstances, a cartridge is locked into the chamber of a barrel when it is fired. The chamber of the barrel contains the pressure created by the burning powder, thus forcing the bullet down the barrel. If the cartridge is fired out of battery, high-pressure gases and fragments of the burst cartridge case are directed into the area between the rotor assembly and the main housing that surrounds the rotor assembly. An overpressure situation results primarily from either an obstruction within the barrel or a cartridge having too much powder. In the event of an overpressure situation, high-pressure gases will blow out through the base of the cartridge case releasing these gases and shrapnel into the area between the rotor assembly and the main housing.

It would therefore be advantageous to provide an improved minigun design that will eliminate the hazards associated with hang fires and overpressure situations. In accordance with the illustrated preferred embodiment of the present invention, a vented rotor assembly serves to redirect and dissipate high-pressure gases and shrapnel forward through the rotor assembly and away from the operator.

DETAILED DESCRIPTION OF A PREFERRED EMBODIMENT

Figure 1B:
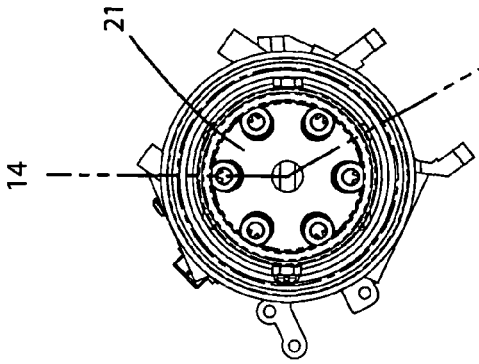
FIG. 1B is a front end view of the minigun of FIG. 1A.
Figure 1A:
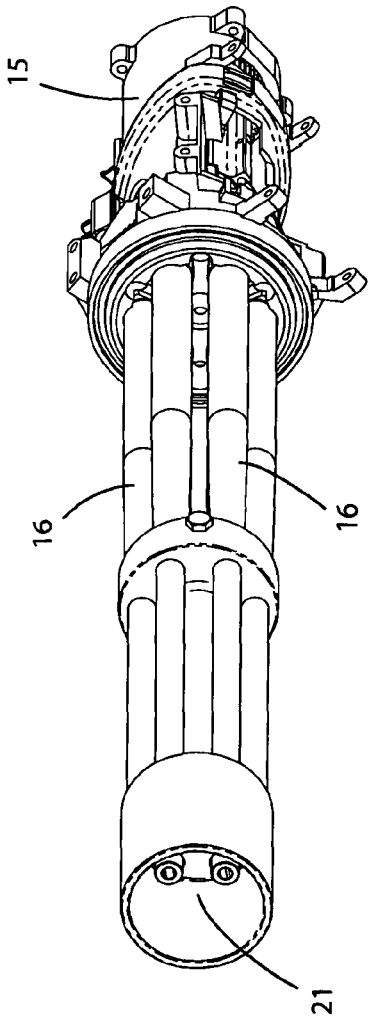
FIG. 1A is a pictorial diagram of a 7.62 mm minigun constructed in accordance with the present invention.
Figure 2:
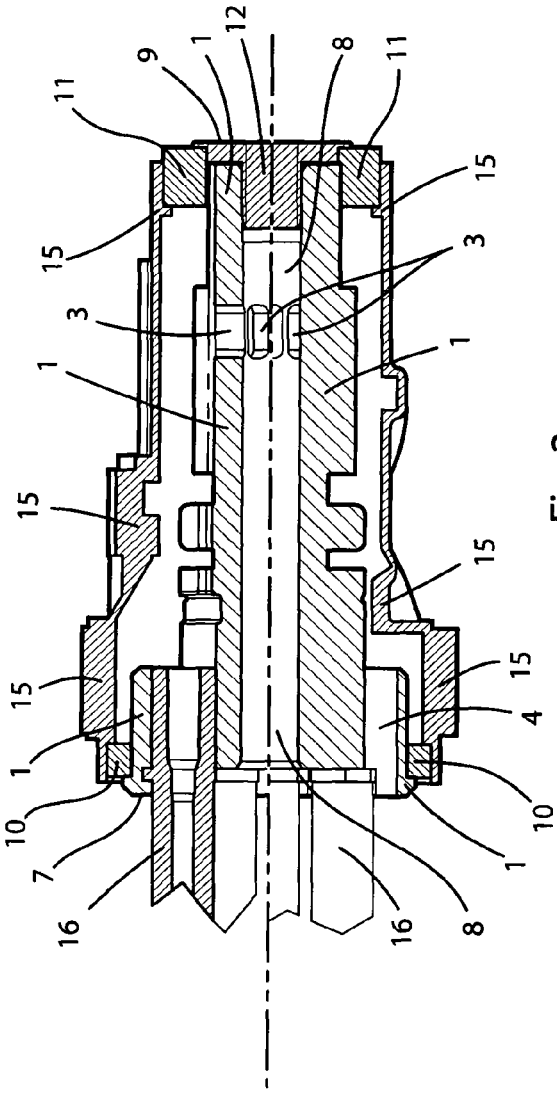
FIG. 2 is a cross-sectional diagram of a portion of the minigun of FIGS. 1AB, taken along section line 14-14 of FIG. 1B, illustrating the forward and radial pressure relief vents in the rotor assembly portion thereof, in accordance with the present invention.

Referring now to FIGS. 1A-B, there is shown a 7.62 minigun having six barrels 16 terminating at a forward end 21 of the minigun and having a main housing 15. Referring additionally to FIG. 2, there is shown a cross-sectional diagram of a portion of the minigun of FIGS. 1A-B containing a rotor assembly 1 constructed in accordance with the present invention to include a plurality of radial pressure relief vents 3 and a plurality of forward pressure relief vents 4. FIG. 2 also illustrates a surface 7 representing the forward end of rotor assembly 1, a surface 9 representing the operator's end of the minigun, a forward bearing 10, a rear bearing 11, and a rotor cap 12. In the detailed perspective diagram of FIG. 3, rotor assembly 1 is shown separated from barrels 16 and main housing 15 of the minigun. Rotor assembly 1 includes six conventional barrel locator orifices 2 and a conventional axial opening 8. Axial opening 8 facilitates manufacture of rotor assembly 1. In addition, rotor assembly 1 includes the aforementioned plurality of radial pressure relief vents 3 and forward pressure relief vents 4.

Figure 3:
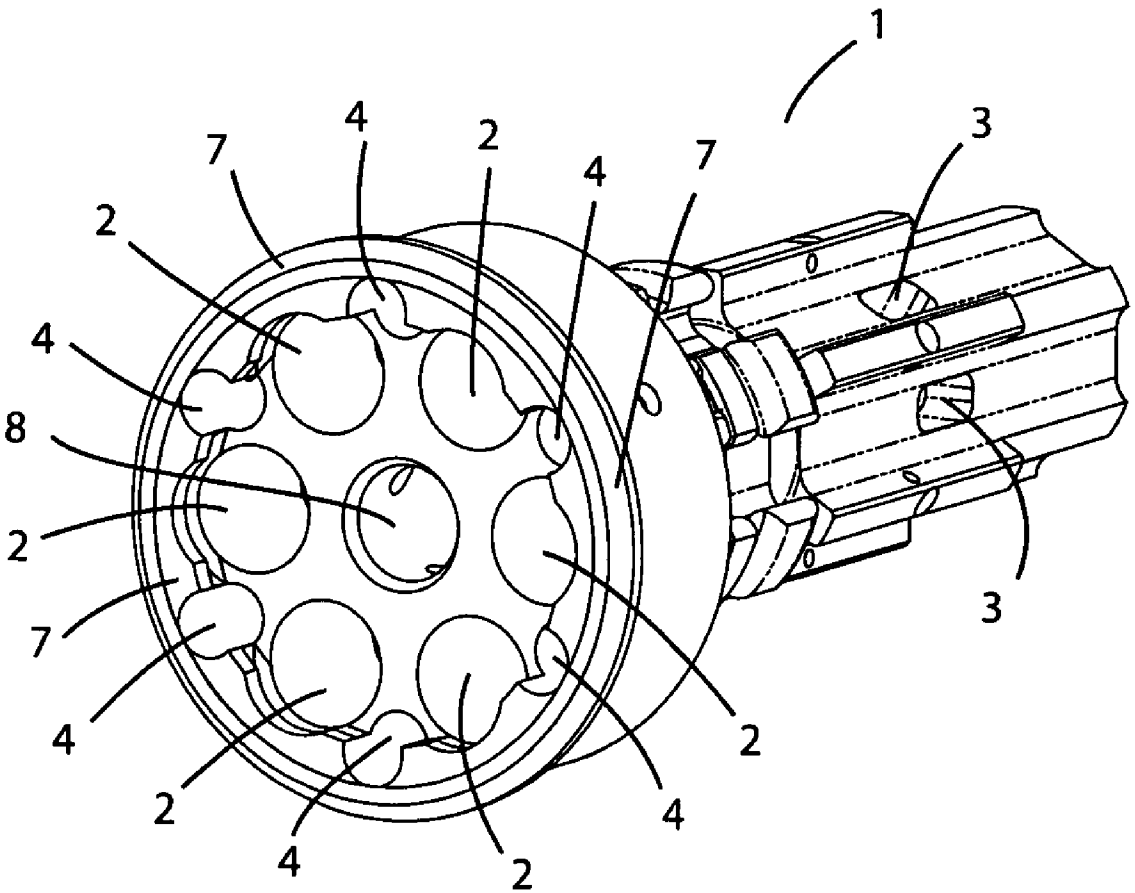
FIG. 3 is a detailed perspective view of the rotor assembly portion of the —minigun of FIGS. 1A, 1B, and 2.
Figure 5:
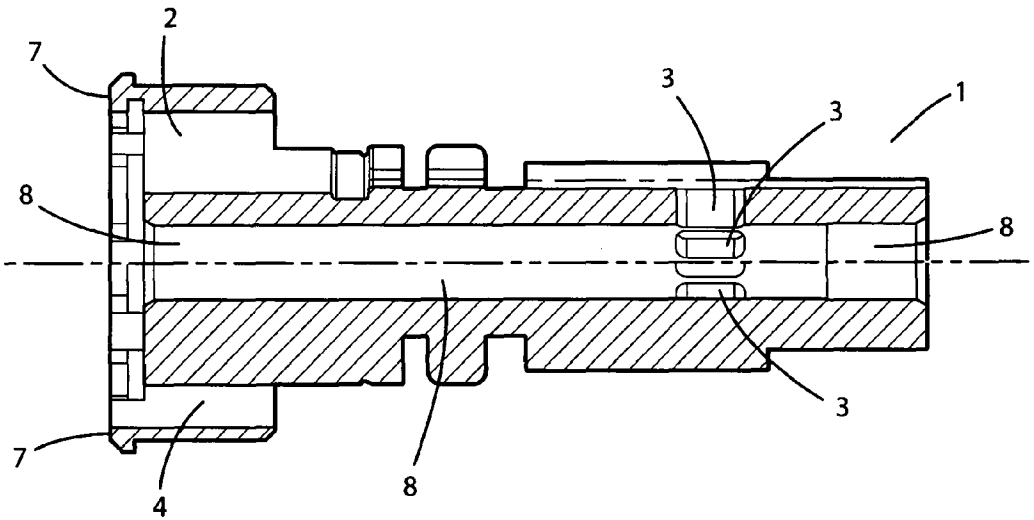
FIG. 5 is a cross-sectional diagram of the rotor assembly of FIG. 3, taken along section line 14-14 of FIG. 4.
Figure 4:
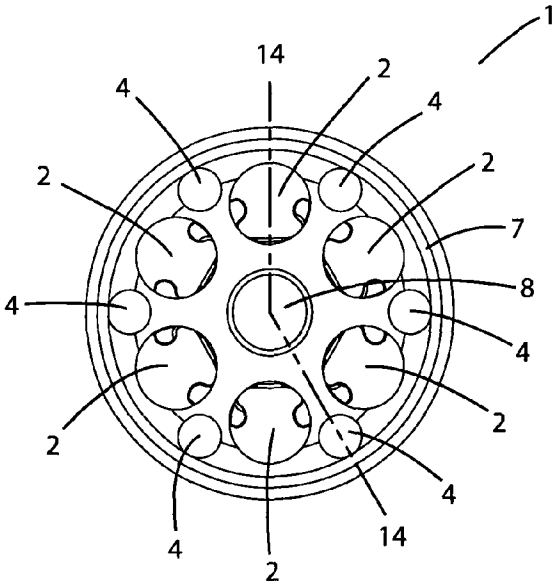
FIG. 4 is a front end view of the minigun rotor assembly of FIG. 3.

Referring now to FIGS. 4 and 5, there are shown a front end view of the rotor assembly 1 of FIG. 3 and a cross-sectional diagram thereof, respectively. FIG. 4 again illustrates the forward pressure relief vents 4 that are positioned radially from axial opening 8, between adjacent ones of the barrel orifices 2, and generally parallel to barrel orifices 2. In addition, FIG. 5 illustrates the radial pressure relief vents 3 and the way in which they intersect axial opening 8.

Figure 6:
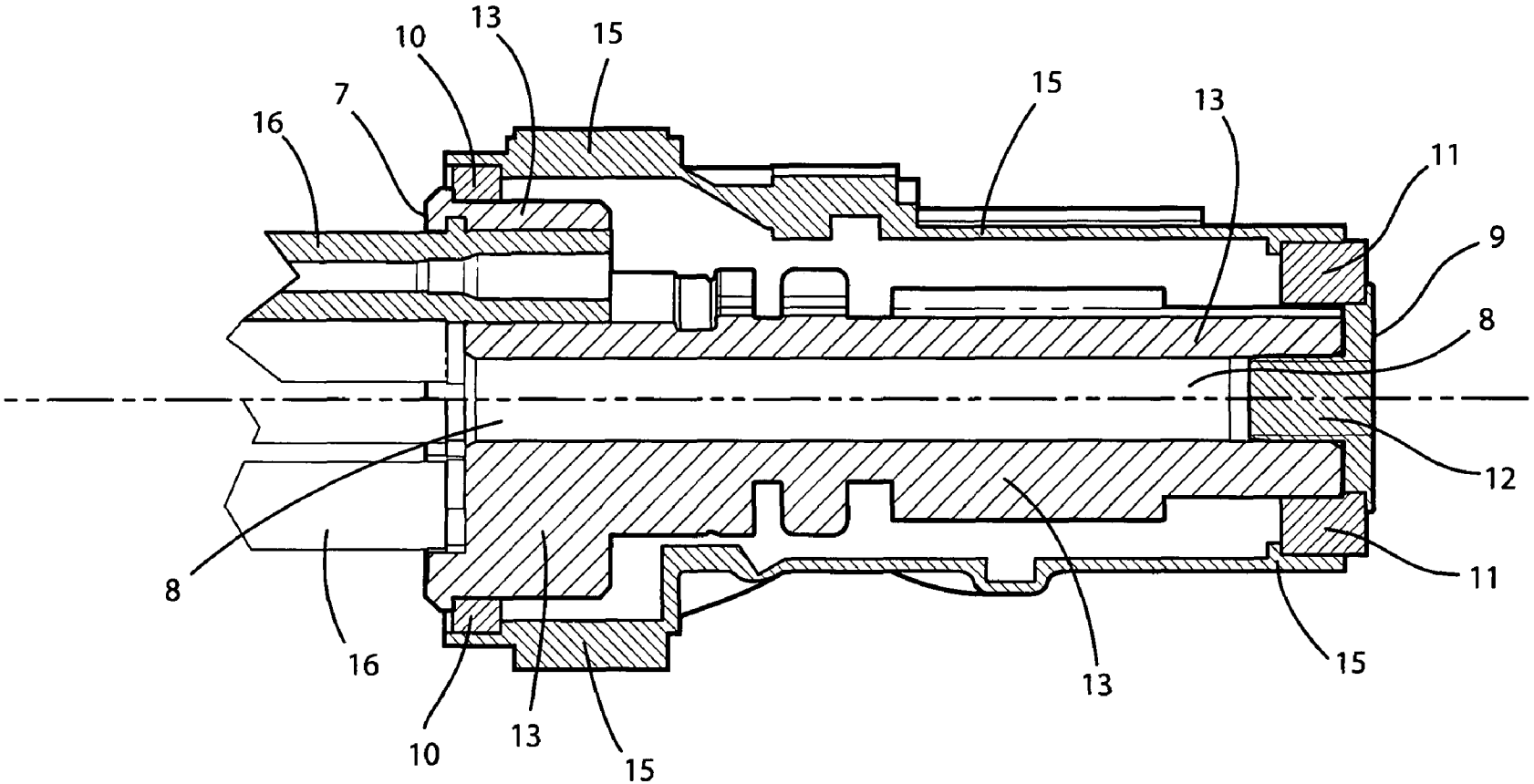
Fig. 6 (Prior Art)
FIG. 6 is a cross-sectional view of a portion of a prior art minigun illustrating a rotor assembly that does not include the forward and radial pressure relief vents of the present invention.

Referring now to FIG. 6, there is shown a prior art rotor assembly 13 installed in main housing 15. Prior art rotor assembly 13 does not include the radial or forward pressure relief vents 3, 4 of the present invention that are illustrated in FIGS. 2-5.

Figure 7:
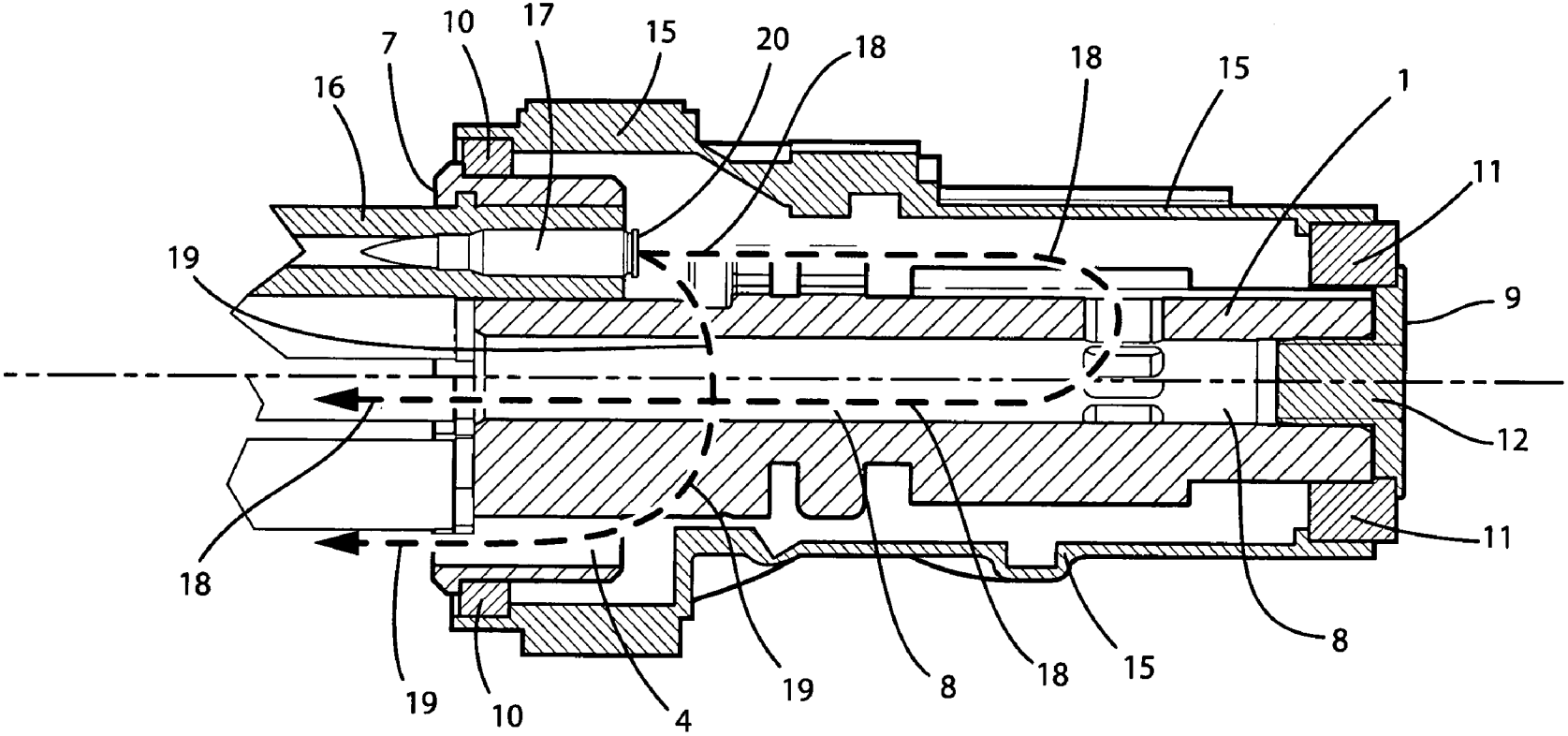
FIG. 7 is a cross-sectional diagram of a portion of the minigun of FIGS. 1A and 1B, illustrating the flow of high-pressure gases and debris through the forward and radial pressure relief vents in the case of an over pressure situation.

Referring now to FIG. 7, there is shown the detailed cross-sectional diagram of FIG. 2, including a cartridge 17 chambered in one of the barrels 16. In the event of a hang fire or overpressure situation, high-pressure gases emanate from the vicinity of a base 20 of cartridge 17. These gases, as well as debris, flow along the path 19, through the forward pressure relief vents 4, so as to exit rotor assembly 1 forward and away from the operator of the minigun who is positioned behind surface 9. Similarly, these gases and debris also flow along the path 18, through the radial pressure relief vents 3, so as to exit rotor assembly 1 through axial opening 8.

While the above is discussed in terms of preferred and alternative embodiments, the invention is not intended to be so limited.

What is claimed is:

1. A machine gun comprising:

a housing defining a chamber and having a housing opening facing a forward direction a rotor rotatably received in the chamber for rotation about a rotor axis;

a plurality of barrels extending in a forward direction from the rotor;

the rotor having a closure portion occupying the housing opening; and the closure portion defining a vent aperture, such that gas pressure occurring within the chamber escapes via the vent aperture in the forward direction.

2. The machine gun of claim 1 wherein the housing is enclosed on a rear side and all lateral sides, such that gas escape is primarily limited only to the forward direction.

3. The machine gun of claim 1 wherein the vent aperture defines a vent axis parallel to the rotor axis.

4. The machine gun of claim 1 wherein the vent aperture defines a vent axis coincident with the rotor axis.

5. The machine gun of claim 1 wherein the closure portion is a forward portion of the rotor.

6. The machine gun of claim 1 wherein the rotor and housing define a peripheral chamber portion internal to the housing, and external to at least a major portion of the rotor, and wherein the vent aperture provides gas communication between the peripheral chamber portion and the exterior of the housing.

7. The machine gun of claim 6 wherein gas communication between the peripheral chamber portion and the exterior of the housing is provided by a central passage of the rotor.

8. The machine gun of claim 7 wherein the rotor defines a further gas passage between the central passage and the peripheral chamber portion.

9. The machine gun of claim 1 wherein the vent aperture is positioned away from the rotor axis.

10. The machine gun of claim 9 including a central vent aperture coincident with the rotor axis.

11. The machine gun of claim 1 wherein a plurality of vent apertures are spaced apart in rotational symmetry.

12. The machine gun of claim 1 wherein each vent aperture is positioned adjacent to a different pair of the barrels.

13. The machine gun of claim 1 wherein the vent apertures is one of a plurality of offset vent apertures positioned away from the axis, and wherein the number of offset vent apertures is equal to the number of barrels.

14. The machine gun of claim 1 wherein the vent apertures is one of a plurality of offset vent apertures positioned away from the axis, and wherein each of the offset vent apertures is positioned at an angular position about the rotor axis angularly between the angular positions of an adjacent pair of barrels, such that the offset vent apertures are in alternating positions among the barrels.

15. The machine gun of claim 14 wherein the offset vent apertures are at a different radial position from the rotor axis than are the radial positions of barrel axes defined by the barrels.

16. The machine gun of claim 15 wherein the offset vents are positioned at a greater radius from the rotor axis than are the barrel axes.

17. The machine gun of claim 1 wherein the rotor defines a central passage that extends from the forward end to a rear end of the rotor, entirely passing through the rotor to a rear opening.

* * * * *